US009158231B2

(12) United States Patent
Sunahara

(10) Patent No.: US 9,158,231 B2
(45) Date of Patent: Oct. 13, 2015

(54) IMAGE FORMING APPARATUS HAVING PROCESS CONDITION CONTROL

(71) Applicant: CANON KABUSHIKI KAISHA, Tokyo (JP)

(72) Inventor: Satoshi Sunahara, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/827,556

(22) Filed: Mar. 14, 2013

(65) Prior Publication Data

US 2013/0272726 A1 Oct. 17, 2013

(30) Foreign Application Priority Data

Apr. 13, 2012 (JP) ..... 2012-091750

(51) Int. Cl.
*G03G 15/08* (2006.01)
*G03G 15/00* (2006.01)

(52) U.S. Cl.
CPC ..... *G03G 15/0824* (2013.01); *G03G 15/086* (2013.01); *G03G 15/0849* (2013.01); *G03G 15/0863* (2013.01); *G03G 15/556* (2013.01)

(58) Field of Classification Search
CPC ..... G03G 15/0824; G03G 15/0831
USPC ..... 399/25, 49
See application file for complete search history.

(56) References Cited

U.S. PATENT DOCUMENTS 6,763,200 B2 7/2004 Sakai et al.
6,912,366 B1 * 6/2005 Yamamoto et al. ..... 399/27
7,215,904 B2 5/2007 Hasegawa et al.
2002/0122673 A1 9/2002 Sakai et al.
2003/0128992 A1 * 7/2003 Kabashima ..... 399/27
2005/0175366 A1 8/2005 Hasegawa et al.
2009/0297215 A1 * 12/2009 Munetsugu et al. ..... 399/111
2011/0026972 A1 * 2/2011 Kawamura ..... 399/223

FOREIGN PATENT DOCUMENTS

JP 62-237477 A 10/1987
JP 04-139471 A 5/1992
JP 11296022 A * 10/1999 ..... G03G 21/00
JP 2002-258676 A 9/2002
JP 2003-215893 A 7/2003
JP 2003-280341 A 10/2003
JP 2005-258418 A 9/2005
JP 2009-116248 A 5/2009

OTHER PUBLICATIONS

English translation of Haraguchi, JP 11-296022 A.*

* cited by examiner

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image forming apparatus includes an image bearing member configured to bear an electrostatic latent image, a developing unit including a developing sleeve and containing developer, and a control portion configured to control a process condition for image formation. The control portion changes the process condition for image formation when, in a case where the developing unit detected to have a developer amount smaller than a predetermined amount is removed from a main body of the image forming apparatus, the removed developing unit is remounted to the main body of the image forming apparatus.

14 Claims, 7 Drawing Sheets

IMAGE FORMING APPARATUS HAVING PROCESS CONDITION CONTROL

BACKGROUND OF THE INVENTION

1. Field of the Invention

The present invention relates to an image forming apparatus using an electrophotographic method.

2. Description of the Related Art

Hitherto, there are known inventions relating to an image forming apparatus to which a cartridge including a developing device can be removably mounted as described in Japanese Patent Application Laid-Open Nos. 2003-215893 and S62-237477. The invention described in Japanese Patent Application Laid-Open No. 2003-215893 uses toner to which particles having a polarity opposite to a polarity of the toner are extraneously added. Further, when a toner remaining amount detecting unit detects that a toner remaining amount is a predetermined amount or less, setting of a charge and a developing bias is changed so that toner charged with reverse polarity opposite to a desired polarity is ejected from a developer container at a time of non-image formation. With this configuration, positive fog that increases just before running out of toner is suppressed so that good printed images can be obtained over a long term from an initial stage.

The invention described in Japanese Patent Application Laid-Open No. S62-237477 is an invention relating to an image forming apparatus, in which a display portion displays an indication prompting a user to shake the cartridge when it is determined that the cartridge has run out of toner based on a detection result of a remaining amount detecting sensor. Then, the cartridge is mounted again, and the toner remaining amount is detected. If it is determined again that the cartridge has run out of toner, the display portion displays an indication prompting the user to replace the cartridge.

In addition, as to detection of remaining amount of toner, it is common to indicate, for example, "Toner Low" or "Toner Out" to a user before the cartridge has completely run out of toner to cause a defective image in a printed image which a user wants to output. In other words, when "Toner Out" is indicated, the cartridge has not completely run out of toner, yet.

When "Toner Out" is indicated, the toner inside the cartridge is roughly split into two parts, including a part close to a developing roller and the other part adhering to an inner wall of a developing container. When the cartridge is replaced, these two parts of toner remain without being used.

The toner close to the developing roller is affected by history of printed images, and hence a part carried much by a surface of the developing roller and a part carried little by the surface occur. As a result, evenness of toner coating in a longitudinal direction may be deteriorated as the toner is being consumed. On the other hand, the toner adhering to the inner wall of the developing container and remaining immobile is hardly affected by charge hysteresis of a regulating member.

In this state, if the cartridge is removed and mounted again, toner inside the cartridge is vibrated because a posture of the cartridge is largely changed. As a result, it is possible to move the toner that was not moved and adhering to the inner wall of the developing container.

When the user shakes the cartridge in which a little toner remains, the user usually shakes the cartridge so that the toner moves close to the developing roller. However, the unevenness of the toner coating on the developing roller in the longitudinal direction may remain depending on the handling method.

In addition, even if the unevenness of the toner coating in the longitudinal direction is eliminated, charged state of the toner may be unstable because toner that has been constantly affected by the charge hysteresis and toner that has not been affected by the charge hysteresis are mixed on the surface of the developing roller.

When an image is printed in this state, uneven density in the longitudinal direction of the developing roller may occur in either case described above.

SUMMARY OF THE INVENTION

The present invention provides an image forming apparatus which realizes improvement of a charged state and a stable coating state of toner carried by a developer carrying member in a developing unit of a process cartridge after being removed and mounted as a developer amount in the process cartridge becomes small, so as to obtain a more stable image.

An image forming apparatus according to an embodiment of the present invention, comprising a control portion configured to control a process condition for image formation, wherein the control portion changes the process condition for image formation when, in a case where a developing unit having a developer amount smaller than a predetermined amount is removed from a main body of the image forming apparatus, the developing unit removed is remounted to the main body of the image forming apparatus.

Further features of the present invention will become apparent from the following description of embodiments with reference to the attached drawings.

DESCRIPTION OF THE EMBODIMENTS

In the following, an exemplary mode for carrying out the present invention will be described in detail for an illustrative purpose based on an embodiment with reference to the accompanying drawings. Note that, dimensions, materials, shapes, and relative positions of components, and the like to be described in the embodiment may be changed as appropriate depending on a configuration of an apparatus to which the present invention is applied, or various conditions. Therefore, unless otherwise noted, the scope of the present invention is not limited only to those factors.

Embodiment 1

Figure 1:
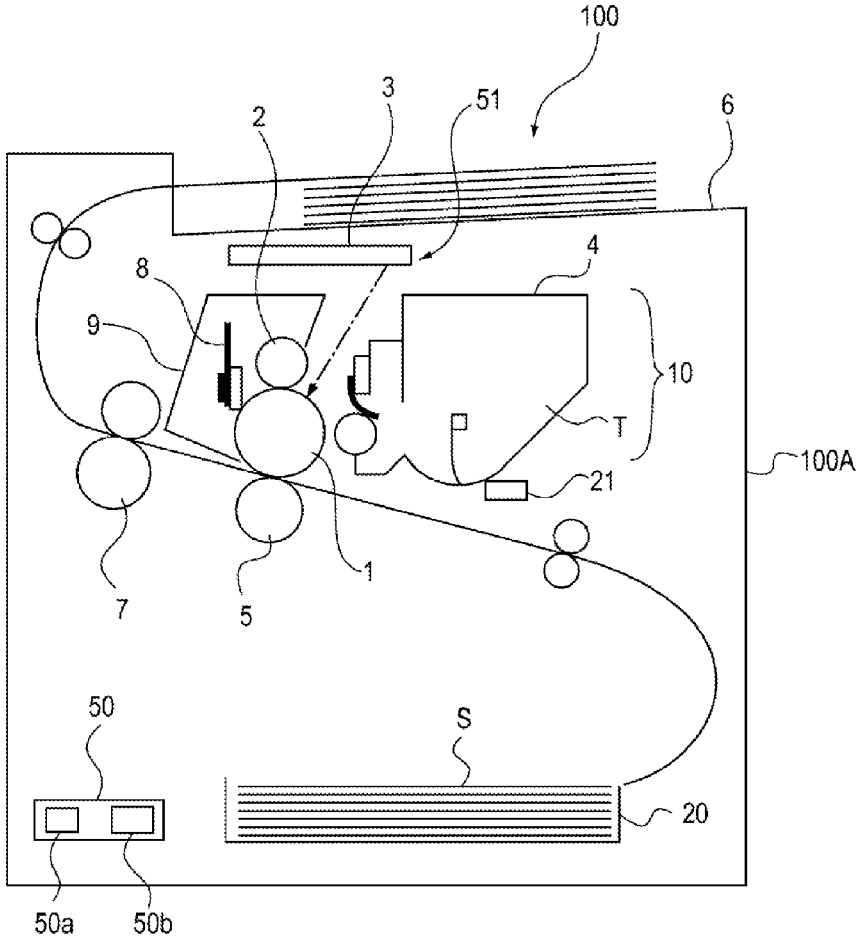
FIG. 1 is a cross-sectional view illustrating a configuration of an image forming apparatus according to Embodiment 1 of the present invention.

FIG. 1 is a cross-sectional view illustrating a configuration of an image forming apparatus 100 according to Embodiment 1 of the present invention. The image forming apparatus 100 is an image forming apparatus utilizing an electrophotographic image forming process. As illustrated in FIG. 1, the image forming apparatus 100 has a main body of the image forming apparatus (hereinafter referred to simply as "apparatus main body") 100A, and an image forming portion 51 configured to form an image is provided inside the apparatus main body 100A. The image forming portion 51 includes a photosensitive drum 1 as an "image bearing member" and a transfer roller 5 as a "transfer device".

The embodiment describes a case where a detection sensor detects "Toner Out", and afterward the cartridge is removed and mounted to be further used. Referring to FIG. 1, an operation of the image forming apparatus 100 will be described below. The photosensitive drum 1 contacts with a charging roller 2 as a contact charging member, and a charging bias is applied to the charging roller 2 so that a surface of the photosensitive drum 1 is uniformly charged. Further, an exposure device (a device configured to emit a light beam such as a laser beam) 3 as an exposure unit exposes the surface of the photosensitive drum 1 to form an electrostatic image. After that, the photosensitive drum 1 is developed with toner (developer) T by a developing device 4 so as to form a toner image (developer image) on the surface thereof.

On the other hand, a sheet S contained in a feed cassette 20 is conveyed to a nip between the photosensitive drum 1 and the transfer roller 5, and the developer image is transferred onto the sheet S by the transfer roller 5. After that, the sheet S is conveyed to a fixing device 7 as a fixing unit which fixes the image to the sheet S, and is discharged onto a tray 6. The toner T remaining on the surface of the photosensitive drum 1 is collected into a cleaner container 9 by a cleaning blade 8. Note that, in the embodiment, the developing device 4, the photosensitive drum 1, the charging roller 2, the cleaning blade 8, and the cleaner container 9 constitute an integrated cartridge 10, which can be mounted and removed from the apparatus main body 100A, as a replaceable unit.

In addition, inside the apparatus main body 100A, there is disposed a controller (control portion) 50 configured to control drive of internal devices of the apparatus main body 100A. In addition, the controller 50 includes a storage portion 50*a* and a number of times detecting portion 50*b*. The storage portion 50*a* and the number of times detecting portion 50*b* will be described later. Further, the apparatus main body 100A includes a switch 21 configured to detect whether or not the cartridge 10 is mounted.

Figure 2:
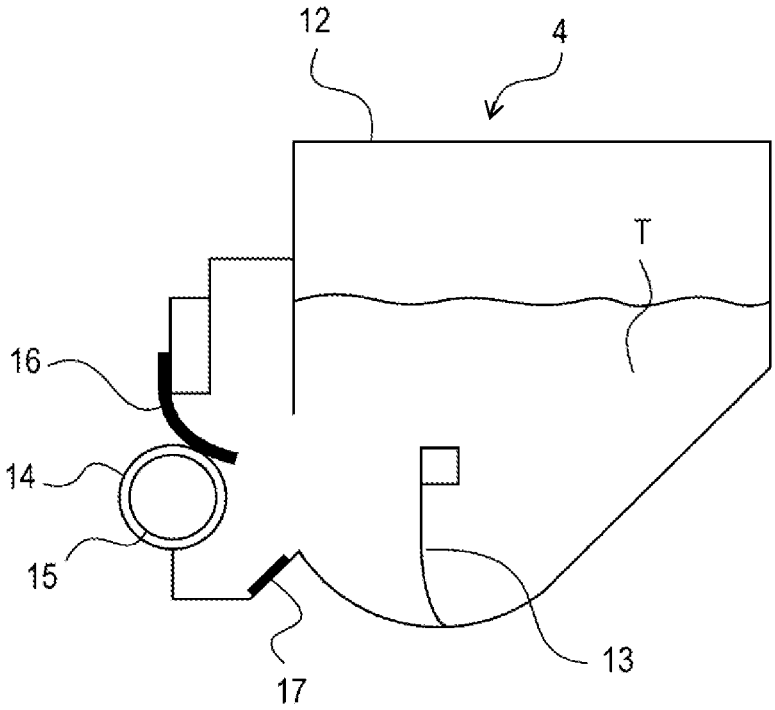
FIG. 2 is a cross-sectional view illustrating a configuration of a developing device.

FIG. 2 is a cross-sectional view illustrating a configuration of the developing device 4. The developing device 4 includes a toner container 12 as a "developing device main body". The toner container 12 contains the toner T that is a single-component magnetic developer. An agitating member 13 is rotatably disposed in the toner container 12, and configured to feed the toner T to a developing portion. The fed toner T is received by a developing sleeve 14 as a "developer carrying member". A magnet roller 15 as a magnetic field generating unit is inserted in the developing sleeve 14. In the state where the cartridge 10 is mounted to the apparatus main body 100A, the magnet roller 15 is fixed, and the developing sleeve 14 is supported so as to be rotatable in one direction around the magnet roller 15. The toner T on the surface of the developing sleeve 14 is conveyed by magnetic force of the magnet roller 15 and rotation force of the developing sleeve 14.

The conveyed toner T is regulated by a blade 16 as a developer regulating member to be a certain amount and is further charged by friction with the blade 16 and the developing sleeve 14. The charged and regulated toner T develops the electrostatic image formed on the photosensitive drum 1 with a developing bias (not shown) applied to the developing sleeve 14.

An electrode 17 as a "detection sensor" or an "amount detection unit" configured to detect an amount of toner T that is a "developer amount" inside the cartridge 10 as a "process cartridge" including a developing unit is attached to an inner wall surface of the toner container 12. The electrode detects an amount of toner T close to the developing sleeve 14. When the developing bias is applied to the developing sleeve 14, a voltage induced at the electrode 17 is detected, and a calculation process is performed so as to detect the amount of toner close to the developing sleeve 14. The detection by the electrode 17 utilizes a fact that the induced voltage varies depending on the amount of toner between the developing sleeve 14 and the electrode 17.

Further, based on this fact, the controller 50 performs the following control. Specifically, when the cartridge 10 is mounted to the apparatus main body 100A, the controller 50 first controls the electrode 17 to detect an amount of toner T inside the cartridge 10. Further, if a user removes and mounts the cartridge 10 after the controller 50 determines that the amount of toner T inside the cartridge 10 becomes small based on a detection result detected by the electrode 17, the controller 50 performs the following control. Specifically, when, in a case where the cartridge 10 containing developer of which an amount is smaller than a predetermined amount is removed from the main body of the image forming apparatus, the cartridge 10 removed is remounted to the main body of the image forming apparatus, the controller 50 changes a process condition for forming an image. In addition, the controller 50 controls to change the process condition (a process condition for an image formation) inside the apparatus main body 100A depending on whether the cartridge 10 is a used cartridge 10 that is already used or a separate cartridge 10 that is mounted separately. The change of the process condition includes extending a pre-rotation time for the photosensitive drum 1 disposed inside the apparatus main body 100A to rotate at least before an image formation.

Specifically, the controller 50 performs the following control based on the detection result detected by the electrode 17. In other words, if the amount of toner T inside the cartridge 10 is smaller than a predetermined amount, the controller 50 extends the pre-rotation time. If the amount of toner T inside the cartridge 10 is larger than the predetermined amount, the controller 50 does not extend the pre-rotation time.

A procedure of detecting whether the cartridge 10 is mounted or removed will be described. When the cartridge 10 is mounted to a predetermined position of the apparatus main body 100A, the switch 21 (see FIG. 1) of the apparatus main body 100A accordingly works so as to detect whether or not the cartridge 10 is mounted to the apparatus main body 100A.

When the cartridge 10 is mounted to the apparatus main body 100A, identification information of the cartridge is read by the controller 50 (see FIG. 1) of the apparatus main body 100A. The identification information is stored in the storage portion 50*a* of the controller 50. Then, if the used cartridge 10 is removed and then a separate cartridge 10 is mounted, identification information of the separate cartridge 10 mounted is verified with identification information of the used cartridge 10. Then, it is detected whether the used cartridge 10 is mounted or a new cartridge 10 is mounted.

As described above, the detection of removing and mounting of the cartridge 10 is performed by the detection as to whether the cartridge 10 is mounted and the verification of the identification information.

Figure 3:
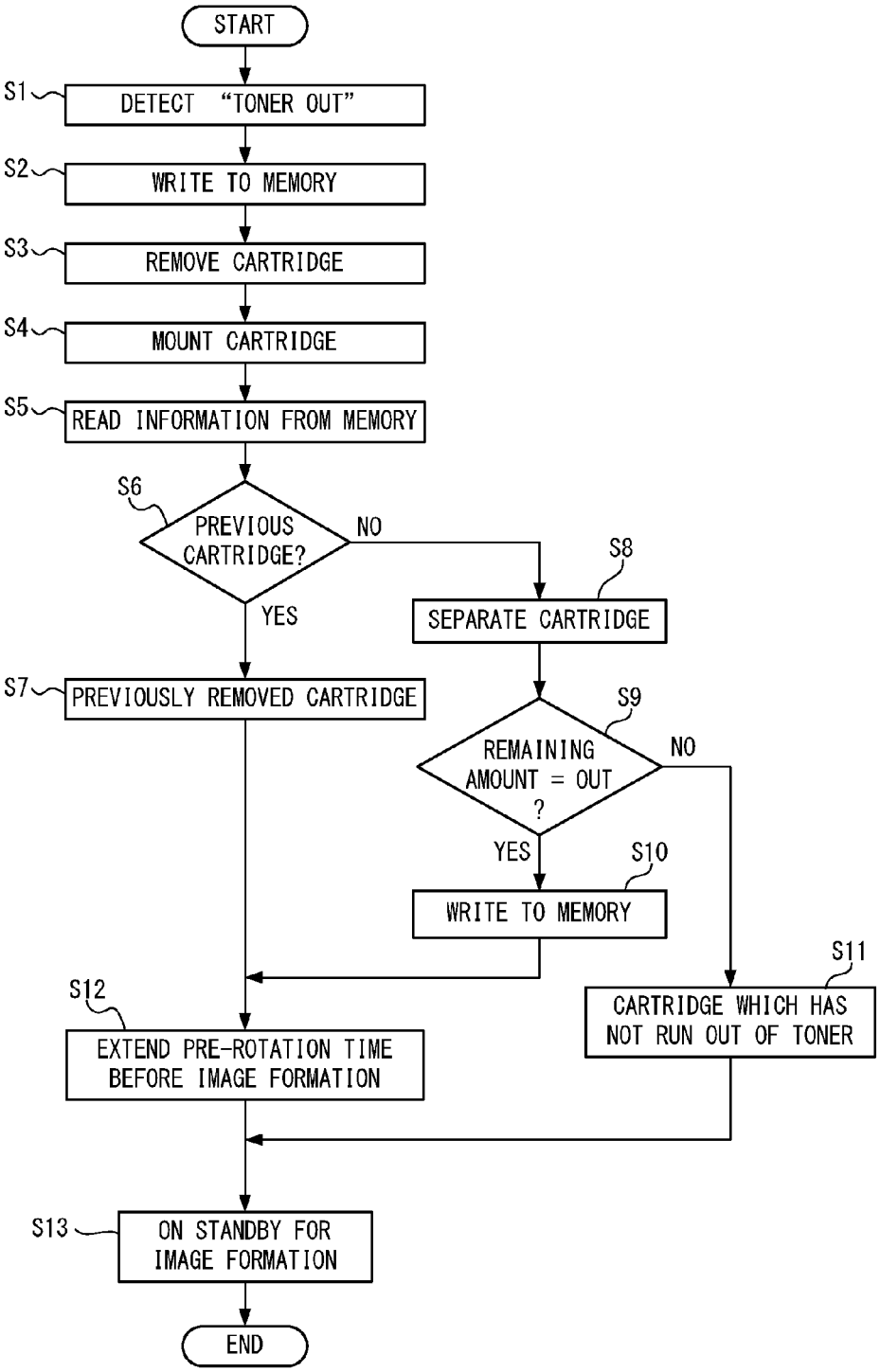
FIG. 3 is a flowchart illustrating a control sequence of a controller.

FIG. 3 is a flowchart illustrating a control sequence of the controller 50. The flowchart of FIG. 3 illustrates the control sequence in the case where the cartridge 10 mounted to the image forming apparatus 100 is detected to be the state of "Toner Out" (in which remaining toner is very little), and then the cartridge 10 is removed and mounted only once. Here, the pre-rotation time before an image formation is extended after the cartridge 10 is removed and mounted. Note that, FIG. 3 partially includes user's operation (S3 and S4).

In addition, the embodiment is compared with the following Comparative Example 1. Comparative Example 1 has the following configuration.

Figure 4:
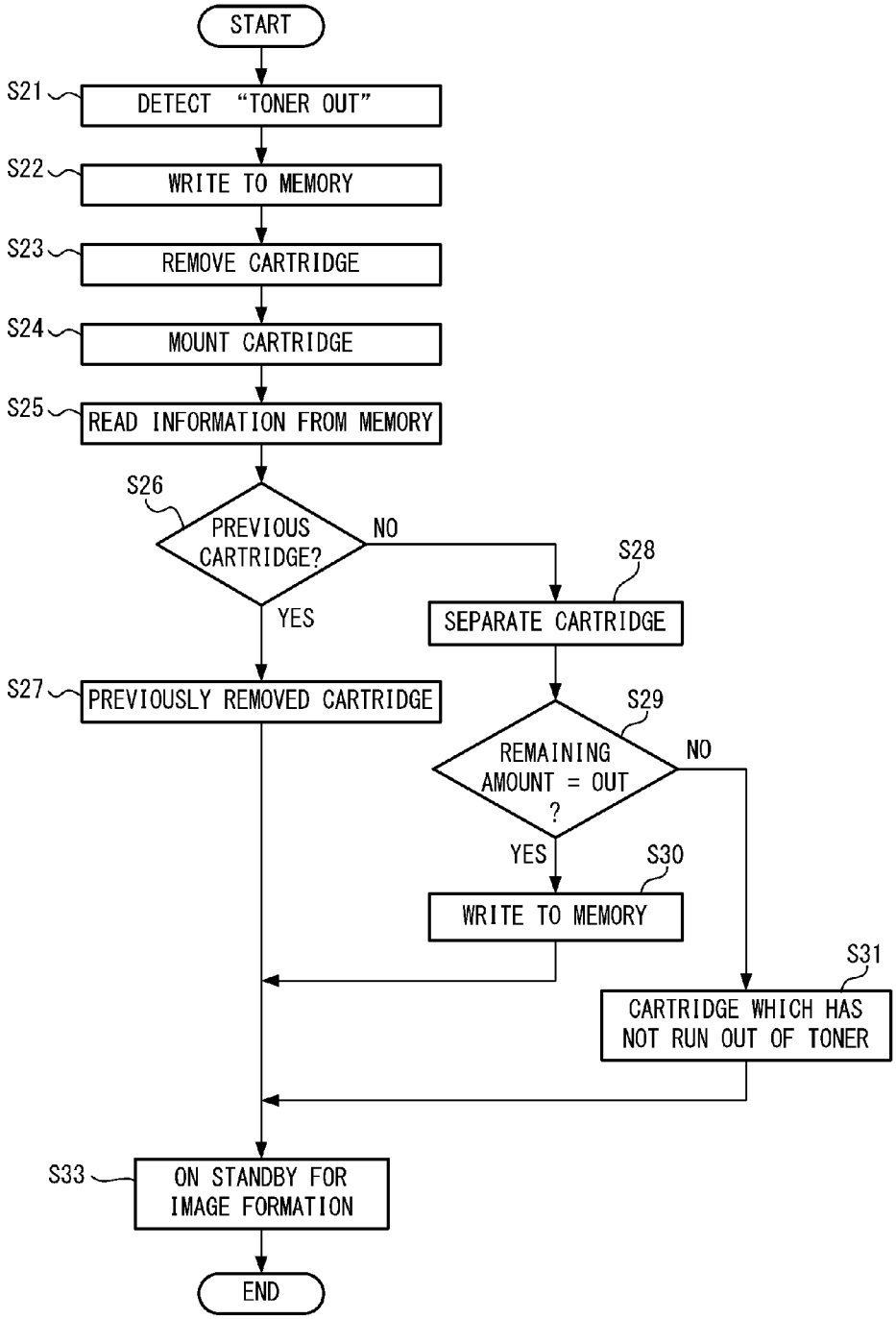
FIG. 4 is a flowchart illustrating a control sequence of a controller provided in an image forming apparatus according to Comparative Example 1.

In Comparative Example 1, after the cartridge 10 is removed and mounted, the pre-rotation time is not extended in any time, and the same setting is used before and after the cartridge 10 is removed and mounted. FIG. 4 is a flowchart illustrating a control sequence of a controller provided in an image forming apparatus according to Comparative Example 1. Note that, the cartridge 10 is removed and mounted when the toner remaining amount of the cartridge 10 is detected to be "Toner Out" in each of Embodiment 1 and Comparative Example 1.

First, as illustrated in FIG. 3, in Embodiment 1, the electrode 17 detects "Toner Out" (Step 1; hereinafter "Step" is simply written as "S" like S1). In the apparatus main body 100A, the controller 50 reads the identification information of the cartridge 10 and stores the identification information together with information of "Toner Out" in the storage portion (memory) 50*a* as a part of the controller 50 (S2). The user removes the cartridge 10 from the apparatus main body 100A (S3). The user mounts the cartridge 10 to the apparatus main body 100A (S4). Memory information of the mounted cartridge 10 is read (S5). The controller 50 determines whether or not the cartridge 10 mounted to the apparatus main body 100A is the cartridge 10 that the user previously removed (namely, whether or not the cartridge 10 is the cartridge previously removed or a separate cartridge) based on record in the storage portion 50*a* described above (S6).

As a result of the comparison in S6, if the cartridge 10 is the cartridge previously removed, it is determined that the "Toner Out" cartridge is remounted (S7). Otherwise (in the case other than S7) as the result of the comparison in S6, it is determined that the cartridge 10 is not the cartridge previously removed but a separate (other) cartridge 10 (S8). After the determination in S8, a remaining amount of toner is detected so as to determine whether or not "Toner Out" has occurred (S9).

As a result of the determination in S9, if it is determined that "Toner Out" has occurred, it is determined that the "Toner Out" cartridge is remounted, and "Toner Out" information is written together with identification information of the cartridge 10 in the storage portion of the controller 50 (S10). As the result of the determination in S9, if it is not determined that "Toner Out" has occurred, it is determined that a separate cartridge 10 is mounted (S11).

If it is determined that the "Toner Out" cartridge is remounted as in S10, the mode is changed to extend the pre-rotation time before an image formation (S12). Then, the apparatus becomes a standby state (S13). If it is determined that the cartridge 10 is not "Toner Out" as in S11, the apparatus directly becomes the standby state (S13).

Note that, if it is determined that the "Toner Out" cartridge is remounted as in S7, the mode is changed to extend the pre-rotation time before an image formation (S12). Then, the apparatus becomes a standby state (S13).

Note that, in the above-mentioned S3 and S4, the switch 21 of the apparatus main body 100A works as described above to detect whether or not the cartridge 10 is mounted to the apparatus main body 100A. In addition, the identification information of the cartridge 10 recorded in S2 is compared with the identification information of the cartridge 10 read in S5, and hence it is determined whether the cartridge 10 is the remounted cartridge or the separate cartridge 10 (S6, S7, and S8).

In Comparative Example 1, the pre-rotation time is not changed in either case. As S21 to S33 in Comparative Example 1 are the same as S1 to S11 and S13 in Embodiment 1, the description in Embodiment 1 is incorporated in the Comparative Example 1 to omit a redundant description. In addition, control of Comparative Example 1 is different from that of Embodiment 1 in that the Comparative Example 1 does not include S12 of Embodiment 1.

Figure 5A:
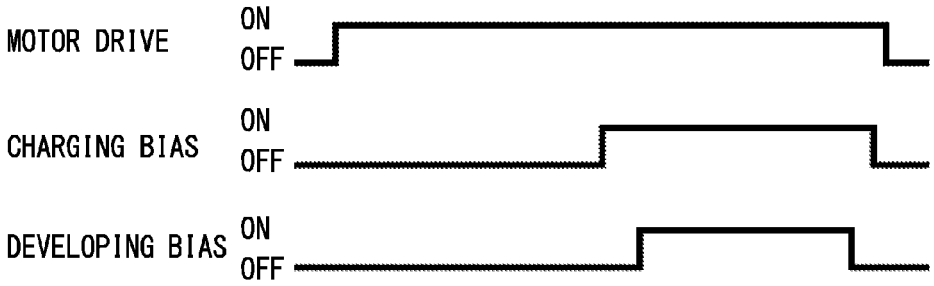
FIG. 5A is a timing chart in a case where the controller extends a pre-rotation time.
Figure 5B:
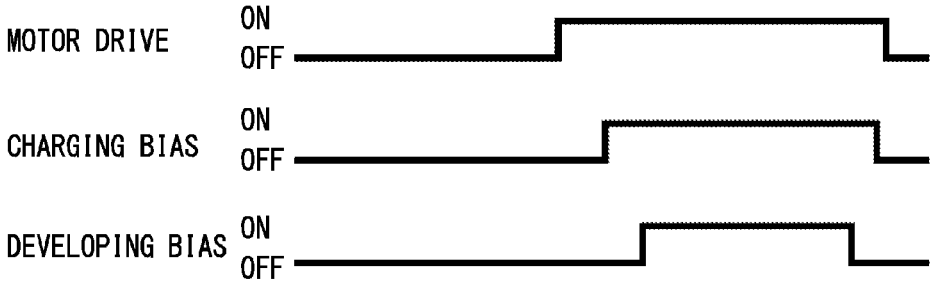
FIG. 5B is a timing chart in a case where the controller does not extend the pre-rotation time.

FIG. 5A is a timing chart illustrating timings of driving a motor of the photosensitive drum 1 and applying the charging bias and the developing bias in the case where the controller 50 extends the pre-rotation time. FIG. 5B is a timing chart illustrating timings of driving the motor of the photosensitive drum 1 and applying the charging bias and the developing bias in the case where the controller 50 does not extend the pre-rotation time. It is understood that the pre-rotation time before an image formation is set longer in FIG. 5A than in FIG. 5B.

Next, actual effects confirmed in Embodiment 1 and Comparative Example 1 will be described. The conditions were as follows. (A) The cartridge 10 that was detected to be "Toner Out" (with a remaining amount of 2%) was used. (B) The cartridge 10 was removed and mounted in that state. (C) The same pattern of image was intermittently printed one by one sheet (with stop between sheets at any time). (D) The pre-rotation time was extended by three seconds.

First, Table 1 shows a result of comparison of the number of sheets that could be printed after "Toner Out" was detected and the cartridge 10 was shaken. In Table 1, oΔ level is a level at which a blocky image can slightly recognized.

TABLE 1

| | Occurrence of blocky image | After Toner Out till first blank area occurrence [sheets] |
|---|---|---|
| The embodiment | none | 24 |
| Comparative Example 1 | 1(oΔ) | 20 |

In Embodiment 1, a blank area occurred in the 24th sheet after removing and mounting. In contrast, in Comparative Example 1, a slightly blocky image appeared in the first sheet, and a blank area occurred in the 20th sheet after mount.

In Comparative Example 1, unevenness of image appeared after remount because unevenness of toner coating occurred after printing on the 15th sheet due to occurrence of the blank area, and because the uneven coat could not be sufficiently eliminated in printing on the first sheet after remount of the cartridge 10. However, an image without a problem was obtained in printing on the second sheet, and this also indicates the effect of the embodiment that uneven coat can be easily eliminated by extending the rotation time. Further, in Comparative Example 1, another blank area occurred again earlier than the embodiment. It is understood that it was harder to eliminate the uneven coat when the toner amount became small in Comparative Example 1 than in the embodiment.

In contrast, in the embodiment, by extending the pre-rotation time, the uneven coat and the uneven charge of the coat can be easily eliminated, and a stable coating state can be kept for a longer period of time. Therefore, it can be said that the embodiment is superior to Comparative Example 1.

In the example, extension of the pre-rotation time for the photosensitive drum 1 disposed inside the apparatus main body 100A to rotate before at least entering an image forming operation is used for changing the process condition for image formation, but this is not a limitation. In other words, it is possible to change to a condition advantageous for developing, for example, by decreasing an image formation speed (process speed) or by adjusting the developing bias. In addition, it is possible to combine the adjustment in speed and bias with the extension of the pre-rotation time.

Instead of promptly removing and remounting the cartridge 10 after "Toner Out" is detected like the embodiment, the cartridge 10 may be removed and remounted when a blank area occurs in continuous use for a while after "Toner Out" is detected. In such a case too, the pre-rotation time after removing and remounting the cartridge 10 may be extended so as to coat a little remaining toner more stably, and hence it is possible to obtain the same effect as the embodiment.

The embodiment has described the case where the removing and mounting is detected after detection of "Toner Out" in the state of a very little remaining toner. However, the removing and mounting may be detected to change the process condition when detecting "Toner Low" (which is a state of more remaining toner amount than "Toner Out" but close to "Toner Out").

In the embodiment, the detection result of the toner remaining amount detecting unit is stored together with the identification information of the cartridge 10 in the controller 50 of the apparatus main body 100A. However, a storage portion may be disposed inside the cartridge 10 and connected to the controller 50 of the apparatus main body 100A. Then, the remaining amount detection result is stored in the storage portion in the cartridge 10. When the cartridge 10 is remounted, the information and the identification information are read from the storage portion in the cartridge 10 in order to detect the removing and mounting for performing the same control.

In the embodiment, the detection unit configured to detect the toner remaining amount uses a method of detecting directly an amount of toner close to the developing sleeve 14. However, it is possible to adopt without any problem a method of processing print image data and counting pixels of printed parts of the image so as to estimate an amount of toner to be consumed.

Embodiment 2

Figure 6:
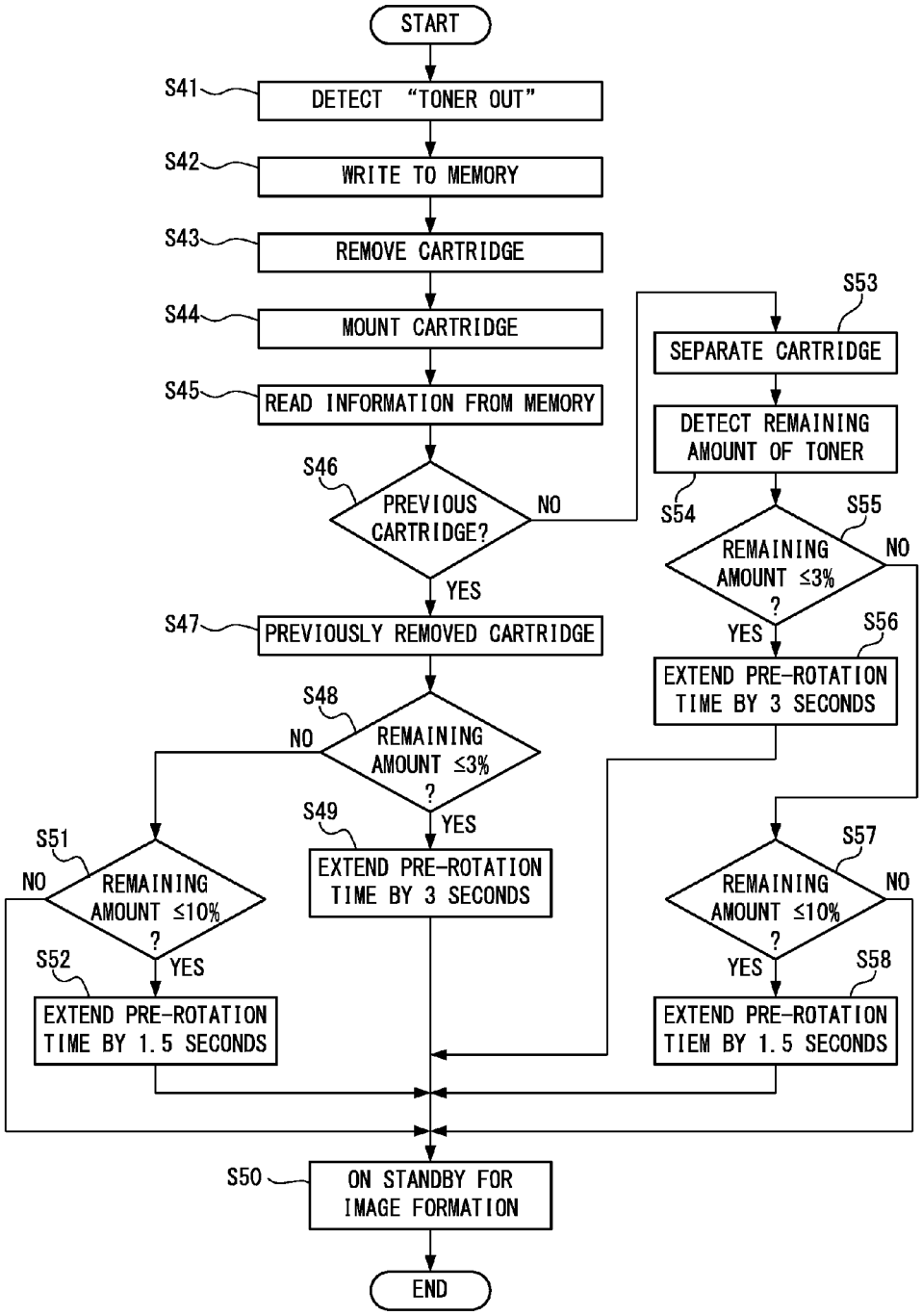
FIG. 6 is a flowchart illustrating a control sequence of a controller provided in an image forming apparatus according to Embodiment 2.

FIG. 6 is a flowchart illustrating a control sequence of the controller 50 of the image forming apparatus 100 according to Embodiment 2. In the configuration of the image forming apparatus 100 of Embodiment 2, the same configuration, control, and effect as the image forming apparatus 100 of Embodiment 1 are denoted by the same reference numeral or symbol so that a description is omitted appropriately. The control sequence of the controller 50 of Embodiment 2 is different from the control sequence of the controller 50 of Embodiment 1 in the following point. Specifically, Embodiment 2 has a feature in that the controller 50 sets the extended amount of time of the pre-rotation time longer as a decreasing rate of the amount of toner T inside the cartridge 10 is larger based on a detection result of the electrode 17. The details are as follows.

Embodiment 1 has described a case where the process condition is changed depending on whether or not "Toner Out" is detected. In contrast, Embodiment 2 describes a case where the process condition is changed in the case where the toner remaining amount of the cartridge 10 is "Toner Low" and in the case where the toner remaining amount is "Toner Out". Unevenness of a charged state is a problem rather than unevenness of the toner coating if the toner amount is relatively large, while stability of the toner coating is a problem if the toner amount is small, as described above. In other words, if the remaining amount of the toner T is relatively large, the pre-rotation time can be short because it is sufficient to charge. In contrast, if the remaining amount of the toner T is relatively small, it is necessary to set the pre-rotation time long because the toner coating is required to be stabilized. In the embodiment, the pre-rotation time is set as shown in Table 2 depending on a value of the result of remaining amount detection when the removing and mounting is performed.

TABLE 2

| | Remaining amount | | |
|---|---|---|---|
| | 10% or more | 3 to 10% | up to 3% |
| Pre-rotation extended amount of time | 0 seconds | 1.5 seconds | 3 seconds |

In FIG. 6, steps for reading information after removing and mounting the cartridge 10 (S41 to S45) are the same as S1 to S5 in FIG. 3 of Embodiment 1. However, the following point is different. Specifically, if it is determined that the cartridge 10 identical with the previous cartridge 10 is mounted (S46 and S47) when the cartridge 10 is mounted, the toner remaining amount information of the cartridge 10 stored previously is read (S42 and S45), and the pre-rotation time is changed depending on the remaining amount information (S48, S49, S51, and S52). If it is determined that a separate cartridge 10 is mounted (S46 and S53) when the cartridge 10 is mounted, the toner remaining amount is detected so as to obtain the toner remaining amount information (S54), and the pre-rotation time is changed depending on the remaining amount information (S55, S56, S57, and S58). The steps after the cartridge 10 is remounted will be described below.

As a result of the determination as to whether or not the cartridge 10 is the previous cartridge 10 (S46), if it is determined that the cartridge 10 previously removed is remounted (S47), it is determined whether or not the toner remaining amount is 3% or smaller (S48).

As a result of the determination in S48, if it is determined that the toner remaining amount is 3% or smaller, the process enters a mode for extending the pre-rotation time by 3 seconds (S49) and then enters a standby mode (S50). As a result of the determination in S48, if it is determined that the toner remaining amount is not 3% or smaller, it is determined whether or not the toner remaining amount is 10% or smaller (S51). As a result of the determination in S51, if it is YES, namely if it is determined that the toner remaining amount is larger than 3% and is 10% or smaller, the process enters a mode for extending the pre-rotation time by 1.5 seconds (S52) and then enters a standby mode (S50). If it is determined that the toner remaining amount is larger than 10%, the process enters the standby mode without entering a mode for extending the pre-rotation time (S50).

As a result of the determination in S46, if it is determined that a new cartridge 10 is mounted (S53), the toner remaining amount is detected anew (S54) because the controller 50 has only information of the previous cartridge 10. Then, it is determined whether or not the toner remaining amount is 3% or smaller (S55).

As a result of the determination in S55, if the toner remaining amount is 3% or smaller, the process enters a mode for extending the pre-rotation time by 3 seconds (S56), and then enters the standby mode (S50). As a result of the determination in S55, if the toner remaining amount is not 3% or smaller, it is determined whether or not the toner remaining amount is 10% or smaller (S57). As a result of the determination in S57, if it is YES, namely if it is determined that the toner remaining amount is larger than 3% and is 10% or smaller, the process enters the mode for extending the pre-rotation time by 1.5 seconds (S58) and then enters the standby mode (S50). As a result of the determination in S57, if it is NO, namely if it is determined that the toner remaining amount is larger than 10%, the process enters the standby mode without entering a mode for extending the pre-rotation time (S50).

The effect of the embodiment will be described with reference to Comparative Examples 2 to 4 in which the pre-rotation is performed with the following specification. The specification of Comparative Examples 2 to 4 is shown in Table 3.

TABLE 3

| | Remaining amount | | |
|---|---|---|---|
| | 10% or more | 3 to 10% | 3% or less |
| The embodiment | 0 seconds | 1.5 seconds | 3 seconds |
| Comparative Example 2 | 0 seconds | 1.5 seconds | 1.5 seconds |
| Comparative Example 3 | 0 seconds | 3 seconds | 3 seconds |
| Comparative Example 4 | 0 seconds | 0 seconds | 0 seconds |

Note that, in order to show the effect, the pre-rotation time to be actually extended is compared between the case where the cartridge 10 is removed and mounted when the remaining amount of the toner T is 7% and the case where the cartridge 10 is removed and mounted when the remaining amount of the toner T is 2%. In addition, whether or not a blocky image occurs and how many sheets are printed until a blank area occurs in an image after the removing and mounting are compared. A result of the comparison is shown in Table 4.

It is understood from Table 4 that it is not necessary to extend by 3 seconds but it is sufficient to extend by 1.5 seconds if the removing and mounting is performed when the remaining amount of the toner T is 7%. However, if the extension is not performed, a slightly blocky image occurs in the first sheet. Therefore, it is understood that the effect of the extension was obtained. It should be understood that the same effect on an image is obtained even if the extension time is short and hence it is shown that sufficient effect can be obtained in the embodiment and Comparative Examples 2 and 3.

In contrast, if the removing and mounting is performed when the remaining amount of the toner T is 2%, a blocky image of the Δ level occurs in the case of no extension of the pre-rotation time as well as in the case of extension by 1.5 seconds. If the pre-rotation time is extended by 3 seconds, it is possible to realize a level without a problem, which shows that the configuration of the embodiment is superior than Comparative Examples 2 and 4.

From above overall discussion, it is understood that the number of printing sheets can be increased without a problem with an image by extending the pre-rotation time sufficiently in the configuration of the embodiment.

Embodiment 3

Figure 7:
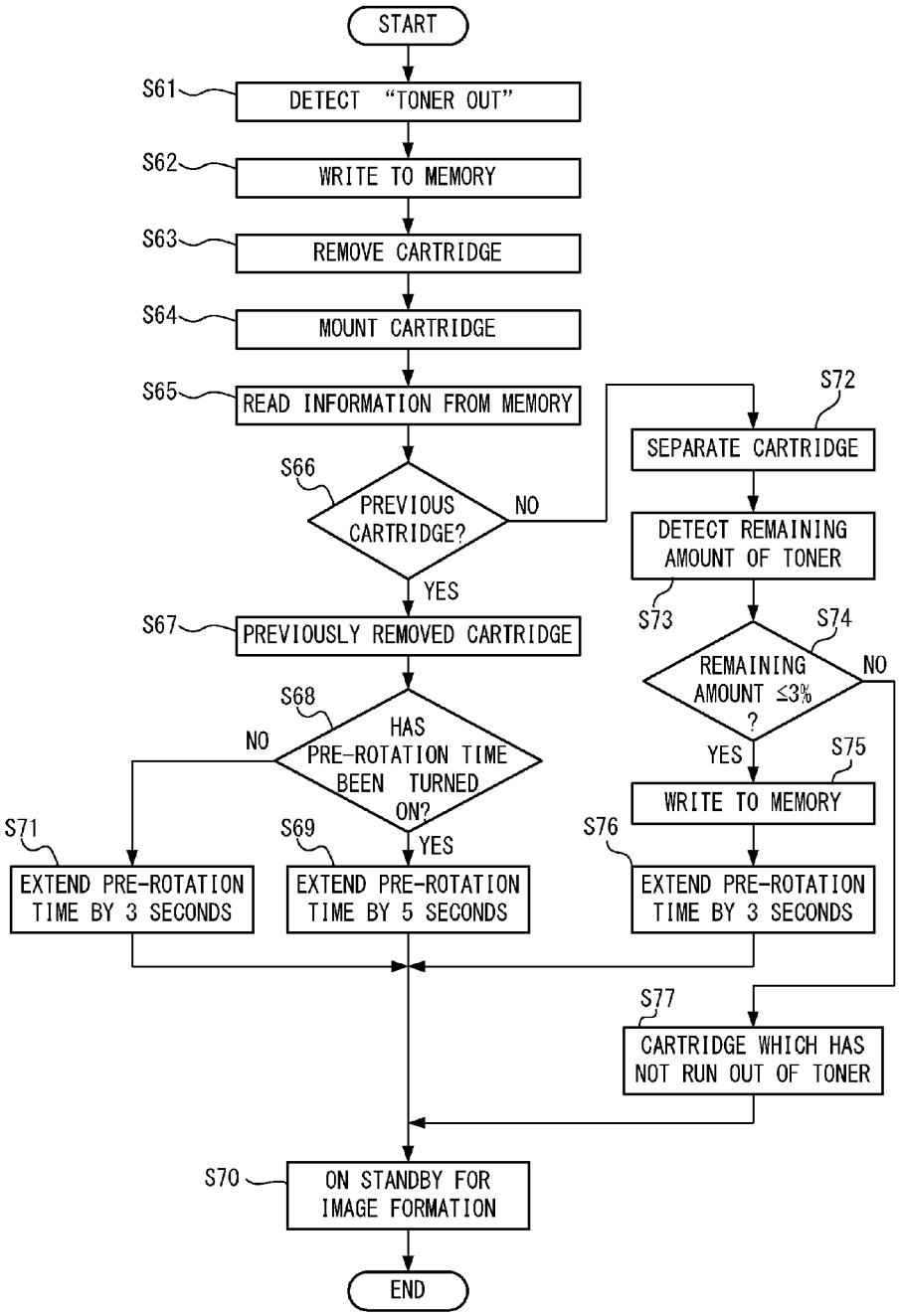
FIG. 7 is a flowchart illustrating a control sequence of a controller provided in an image forming apparatus according to Embodiment 3.

FIG. 7 is a flowchart illustrating a control sequence of the controller 50 of the image forming apparatus 100 of Embodiment 3. In the configuration of the image forming apparatus 100 of Embodiment 3, the same configuration, control, and effect as the image forming apparatus 100 of Embodiment 1 are denoted by the same reference numeral or symbol so that a description is omitted appropriately. The control sequence of the controller 50 of Embodiment 3 is different from the control sequence of the controller 50 of Embodiment 1 or 2 in the following point. Specifically, the controller 50 includes the number of times detecting portion 50*b* (see FIG. 1) configured to detect the number of removing and mounting of the cartridge 10, and the extended amount of time of the pre-rotation time is set longer as the number of removing and mounting of the cartridge 10 becomes larger based on a detection result of the number of times detecting portion 50*b*. The details will be described below.

Embodiments 1 and 2 have described the case where it is determined whether or not to extend the pre-rotation time once the removing and mounting of the cartridge 10. In contrast, the embodiment describes a case where the condition for extending the pre-rotation time is adjusted depending on the number of removing and mounting of the cartridge 10

TABLE 4

| | Remaining amount: 7% | | | Remaining amount: 2% | | |
|---|---|---|---|---|---|---|
| | Extended amount of time | Occurrence of blocky image | After removing and mounting till blank area occurrence [sheets] | Extended amount of time | Occurrence of blocky image | After removing and mounting till blank area occurrence [sheets] |
| The embodiment | 1.5 seconds | none | 52 | 3 seconds | none | 15 |
| Comparative Example 2 | 1.5 seconds | none | 51 | 1.5 seconds | 1(Δ) | 11 |
| Comparative Example 3 | 3 seconds | none | 53 | 3 seconds | none | 15 |
| Comparative Example 4 | 0 seconds | 1(○Δ) | 50 | 0 seconds | 1-2(Δ)<br>3(○Δ) | 9 |

Note that, Δ level is a level at which a light and shade difference is conspicuous more clearly than the ○Δ level.

with respect to the apparatus main body 100A after "Toner Out" is detected. Note that, the case of the embodiment may occur with high probability in view of a jam clearance in the state in which the toner remaining amount is small.

In FIG. 7, the steps of removing and mounting the cartridge 10 so as to read the information (S61 to S65) are the same as S1 to S5 of Embodiment 1 illustrated in FIG. 3. However, the following point is different. Specifically, the different exists in that if the pre-rotation time is already extended when the cartridge 10 is mounted, further extension of the pre-rotation time is performed. Steps after remounting the cartridge 10 will be described.

As a result of determination as to whether or not the cartridge 10 is the previously removed cartridge 10 (S66), if it is determined that the previously removed cartridge 10 is remounted (S67), it is determined whether or not the extension of the pre-rotation time has already been turned "ON" (S68).

As a result of the determination in S68, if the extension of the pre-rotation time has already been turned "ON", the pre-rotation time is extended from 3 seconds to 5 seconds (S69), and the process enters the standby mode (S70). As a result of the determination in S68, if the extension of the pre-rotation time has not yet been turned "ON", the process enters the mode in which the pre-rotation time is extended by 3 seconds (S71) and then enters the standby mode (S70).

As a result of the determination in S66, if it is determined that a separate cartridge 10 is mounted (S72), the toner remaining amount is detected again (S73) because the controller 50 has only information of the previous cartridge 10. Then, it is determined whether or not "Toner Out" has occurred (S74).

As a result of the determination in S74, if it is determined that "Toner Out" has occurred, the remaining amount detection result is written in the memory (S75), and the process enters the mode for extending the pre-rotation time by 3 seconds (S76) and then enters the standby mode (S70). As a result of the determination in S74, if it is determined that "Toner Out" has not occurred (S77), the process directly enters the standby mode (S70).

The effect of the embodiment will be described with reference to Comparative Example 5 in which only the 3-second extension of the pre-rotation time is performed even when the second removing and mounting is performed.

Note that, the embodiment and Comparative Example used the following specification. Specifically, soon after "Toner Out" (remaining amount is 2%) was detected, the cartridge 10 was removed and mounted, and images were printed on ten sheets, and then the cartridge 10 was removed and mounted again, and then the printing was continued.

Table 5 shows the manner in which the pre-rotation time is extended in response to the removing and mounting in the embodiment and Comparative Example 5.

TABLE 5

| | First removing and mounting | Second removing and mounting |
|---|---|---|
| The embodiment | 3 seconds | 5 seconds |
| Comparative Example 5 | 3 seconds | 3 seconds |

Table 6 shows the number of sheets that could be totally printed from the first removing and mounting.

TABLE 6

| | Number of sheets that could be printed |
|---|---|
| The embodiment | 29 |
| Comparative Example 5 | 27 |

The number of sheets that could be printed is larger in the embodiment, and hence it is understood that the effect of extending the pre-rotation time after the second removing and mounting was obtained. However, if the pre-rotation time is extended more, the throughput is simply decreased. Therefore, it is not always good to extend the pre-rotation time. As described above, the effect can be obtained also in the embodiment.

In the embodiment, whether or not the cartridge 10 is removed and mounted is determined based on whether or not the same cartridge 10 has mounted and whether or not the pre-rotation time has already been extended. However, when the cartridge 10 is mounted, the number of mounting may be stored in a storage device.

In addition, as described above, the removing and mounting largely affects a blocky image when the toner remaining amount is small. Therefore, it is sufficient to record the removing and mounting after the toner remaining amount becomes small to a certain extent. In other words, if the toner remaining amount is a predetermined value or larger, the detection of the removing and mounting may not be performed.

According to the configuration of Embodiment 1, 2, or 3, improvement of charging performance and stability of coating state of toner carried by the developing sleeve 14 inside the developing unit can be realized in the cartridge 10 after the removing and mounting of the cartridge 10 in which the amount of toner T becomes small, and hence a more stable image can be obtained. In addition, the toner T remaining inside the cartridge 10 can contribute to the image formation more effectively.

According to the embodiments of the present invention, it is possible to realize improvement of a charged state and a stable coating state of the toner carried by the developer carrying member in the developing unit of the process cartridge after the removing and mounting of the process cartridge in which the developer amount becomes small, so that a more stable image can be obtained.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2012-091750, filed Apr. 13, 2012, which is hereby incorporated by reference herein in its entirety.

What is claimed is:

1. An image forming apparatus, comprising:

a developing unit including a developing roller and containing developer;

a detecting portion detecting an amount of developer in the developing unit; and a control portion configured to control a process condition for image formation, wherein when a removed developing unit is remounted to a main body of the image forming apparatus, a remaining amount of developer is detected, wherein when the remaining amount of developer is less than a predetermined amount the control portion extends a pre-rotation time of the developing unit by a first time, and when the remaining amount of developer is not less than the predetermined amount the control portion extends the pre-rotation time of the developing unit by a second time less than the first time.

2. An image forming apparatus according to claim 1, wherein the control portion extends a rotation time for which an image bearing member configured to bear an electrostatic latent image rotates before an image formation as a change of the process condition for image formation.

3. An image forming apparatus according to claim 1, wherein the control portion avoids changing the process condition for image formation even when, in a case where the developing unit having the predetermined developer amount or larger is removed from the main body of the image forming apparatus, the removed developing unit is remounted to the main body of the image forming apparatus.

4. An image forming apparatus according to claim 2, wherein the control portion sets an extended amount of time of the rotation time longer as the developer amount in the developing unit is smaller.

5. An image forming apparatus according to claim 2, wherein the control portion comprises a detecting portion configured to detect a number of times the developing unit is removed and remounted, and the control portion sets an extended amount of time of the rotation time longer as the detected number of times removing and mounting of the developing unit is larger.

6. An image forming apparatus, comprising:

a removably mounted process cartridge, the process cartridge having an image bearing member configured to bear an electrostatic latent image and a developing unit provided with a developing roller and configured to develop the electrostatic latent image;

a detecting portion detecting an amount of developer in the developing unit; and a control portion configured to control a process condition for image formation, wherein when a removed process cartridge is remounted to a main body of the image forming apparatus, a remaining amount of developer is detected, wherein when the remaining amount of developer is less than a predetermined amount the control portion extends a pre-rotation time of the process cartridge by a first time, and when the remaining amount of developer is not less than the predetermined amount the control portion extends the pre-rotation time of the process cartridge by a second time less than the first time.

7. An image forming apparatus according to claim 6, wherein the control portion extends a rotation time for which the image bearing member rotates before an image formation as a change of the process condition for image formation.

8. An image forming apparatus according to claim 6, wherein the control portion avoids changing the process condition for image formation even when, in a case where the process cartridge having the predetermined developer amount or larger is removed from the main body of the image forming apparatus, the removed process cartridge is remounted to the main body of the image forming apparatus.

9. An image forming apparatus according to claim 7, wherein the control portion sets an extended amount of time of the rotation time longer as the developer amount in the process cartridge is smaller.

10. An image forming apparatus according to claim 7, wherein the control portion comprises a detecting portion configured to detect a number of times the process cartridge is removed and remounted, and the control portion sets an extended amount of time of the rotation time longer as the detected number of times of removing and mounting of the process cartridge is larger.

11. An image forming apparatus according to claim 1, wherein when the remaining amount of developer is not less than a second predetermined amount, the control portion does not extend the pre-rotation time of the developing unit.

12. An image forming apparatus according to claim 6, wherein when the remaining amount of developer is not less than a second predetermined amount, the control portion does not extend the pre-rotation time of the process cartridge.

13. An image forming apparatus, comprising:

a developing unit including a developing roller and containing developer;

a detecting portion detecting an amount of developer in the developing unit; and a control portion configured to control a process condition for image formation, wherein when a removed developing unit is remounted to a main body of the image forming apparatus without refilling, a remaining amount of developer is detected, wherein when the remaining amount of developer is less than a predetermined amount the control portion extends a pre-rotation time of the developing unit by a predetermined time.

14. An image forming apparatus, comprising:

a removably mounted process cartridge, the process cartridge having an image bearing member configured to bear an electrostatic latent image and a developing unit provided with a developing roller and configured to develop the electrostatic latent image;

a detecting portion detecting an amount of developer in the developing unit; and a control portion configured to control a process condition for image formation, wherein when a removed process cartridge is remounted to a main body of the image forming apparatus without refilling, a remaining amount of developer is detected, wherein when the remaining amount of developer is less than a predetermined amount the control portion extends a pre-rotation time of the process cartridge by a predetermined time.

* * * * *